US011215358B2

(12) United States Patent
Dalla Vecchia et al.

(10) Patent No.: US 11,215,358 B2
(45) Date of Patent: Jan. 4, 2022

(54) BURNER UNIT

(71) Applicant: Polidoro S.P.A., Schio (IT)

(72) Inventors: Laura Dalla Vecchia, Santorso (IT); Stefano Dalla Vecchia, Santorso (IT); Domenico Peserico, Valdagno (IT); Massimiliano Benetti, Piovene Rocchette (IT); Alberto Bonollo, Schio (IT)

(73) Assignee: Polidoro S.p.A., Schio (IT)

( * ) Notice: Subject to any disclaimer, the term of this patent is extended or adjusted under 35 U.S.C. 154(b) by 0 days.

(21) Appl. No.: 16/075,921

(22) PCT Filed: Jul. 25, 2018

(86) PCT No.: PCT/IB2018/055569

§ 371 (c)(1),
(2) Date: Aug. 6, 2018

(87) PCT Pub. No.: WO2019/021224

PCT Pub. Date: Jan. 31, 2019

(65) Prior Publication Data

US 2021/0048191 A1 Feb. 18, 2021

(30) Foreign Application Priority Data

Jul. 28, 2017 (WO) ..... PCT/IB2017/054619

(51) Int. Cl.
*F23D 14/14* (2006.01)
*C22C 38/06* (2006.01)
(Continued)

(52) U.S. Cl.
CPC ..... *F23D 14/145* (2013.01); *C22C 38/06* (2013.01); *C22C 38/18* (2013.01); *D03D 9/00* (2013.01);
(Continued)

(58) Field of Classification Search
CPC ..... C22C 38/06; C22C 38/18; D10B 2101/20; D03D 9/00; F23D 14/145; F23D 2203/103
(Continued)

(56) References Cited

U.S. PATENT DOCUMENTS 3,084,736 A * 4/1963 Mentel ..... F23D 14/145 431/329
3,129,749 A 4/1964 Guido
(Continued)

FOREIGN PATENT DOCUMENTS

CN 201092600 Y 7/2008
CN 203847294 U 9/2014
(Continued)

OTHER PUBLICATIONS

Search Report issued in counterpart EP18185976.0.
(Continued)

*Primary Examiner* — Steven B McAllister
*Assistant Examiner* — Benjamin W Johnson
(74) *Attorney, Agent, or Firm* — Andrus Intellectual Property Law, LLP

(57) ABSTRACT

A new and improved gas fired burner unit that can be utilized in applications where low emissions and high efficiency are desired including a burner body having a lower housing unit with a bottom portion, a distribution element located above the bottom portion, a burner deck located above the distribution element, and a metal fiber mesh element located above the burner deck. The burner deck supports the metal fiber mesh and spaces the metal fiber mesh from the internal distribution element to define a burner head. At least one inlet conduit communicates with the burner body and extends into the burner body to deliver a gas/air mixture to the burner body in a region located below the distribution
(Continued)

element and above the bottom portion of the lower housing unit. The burner head has a permeability greater than 700 liters per hour, and the bottom portion of the lower housing unit includes a plurality of ribs providing added rigidity to the burner body and eliminating combustion noise.

22 Claims, 7 Drawing Sheets

(51) Int. Cl.
*C22C 38/18* (2006.01)
*D03D 9/00* (2006.01)

(52) U.S. Cl.
CPC .... *D10B 2101/20* (2013.01); *F23D 2203/103* (2013.01)

(58) Field of Classification Search
USPC ..... 431/329
See application file for complete search history.

(56) References Cited

U.S. PATENT DOCUMENTS

| | | | | | |
|---|---|---|---|---|---|
| 472,533 | A | | 2/1988 | Brimm | |
| 4,725,334 | A | | 2/1988 | Brimm | |
| 5,165,887 | A | * | 11/1992 | Ahmady | F23D 14/16 126/92 AC |
| 5,326,257 | A | * | 7/1994 | Taylor | F23D 14/14 431/329 |
| 5,439,372 | A | | 8/1995 | Duret et al. | |
| 5,520,536 | A | | 5/1996 | Rodgers | |
| 6,262,167 | B1 | | 7/2001 | Weitzel et al. | |
| 2005/0172915 | A1 | * | 8/2005 | O'Donnell | F24H 1/205 122/17.1 |
| 2007/0009847 | A1 | * | 1/2007 | Wu | F23D 14/06 431/354 |
| 2016/0123580 | A1 | | 5/2016 | Van Den Berg et al. | |
| 2016/0238243 | A1 | * | 8/2016 | Gilioli | F23D 14/26 |

FOREIGN PATENT DOCUMENTS

| | | |
|---|---|---|
| JP | 10-68509 | 3/1998 |
| JP | 3073739 | 8/2000 |
| JP | 2001-41421 | 2/2001 |
| KR | 10-2007-0027022 A | 3/2007 |
| WO | 2002099173 | 12/2002 |
| WO | 2015000869 | 1/2015 |

OTHER PUBLICATIONS

International Search Report and Written Opinion issued in PCT/IB2017/054619.
International Search Report and Written Opinion issued in PCT/IB2018/055569.
Office Action dated Aug. 28, 2020 in counterpart JP2018-544102.
First Office Action issued in counterpart CN201880001377.5.
Office Action issued in counterpart JP2018-544102.
Office Action dated Feb. 12, 2020 in counterpart CA3017011.
Search Report dated Aug. 12, 2019 in counterpart CL2033-2018.
Search Report dated Dec. 16, 2019 in counterpart CL2033-2018.
Office Action dated Feb. 21, 2021 in counterpart JP2018-544102.
Office Action dated Jul. 8, 2020 in counterpart KR10-2018-7024769.
Office Action dated Feb. 8, 2021 in counterpart KR10-2018-7024769.

* cited by examiner

BURNER UNIT

CROSS-REFERENCE TO RELATED APPLICATIONS

This application claims priority from International Application PCT/IB2017/054619, filed Jul. 28, 2017, and International Application PCT/IB2018/055569, filed Jul. 25, 2018.

FIELD

The present invention relates generally to burners and, in particular, to a low emissions gas burner.

BACKGROUND

Many types of burners are available for use in gas fired appliances, such as water heaters, boilers, cooking appliances and laundry equipment. Fuel efficient burners configured to produce low emissions are in demand due to federal, state and international emission requirements and efficiency standards.

SUMMARY

The present invention provides new and improved gas fired burner unit that can be utilized in various gas fired appliances. The burner unit of the present invention can be used in applications where low emissions and high efficiency are desired.

In one embodiment of the invention, a burner body having a lower housing unit with a bottom portion and at least one upwardly extending sidewall is disclosed. The lower housing unit engages with an end cap on one end and an inlet cap having an inlet aperture on a second end. A distribution element is located above the bottom portion of the lower housing unit. A burner deck is located above the distribution element, and a metal fiber mesh element is located above the burner deck. The combination of the metal fiber mesh element and the burner deck is herein referred to as the burner head. The distribution element, burner deck, and metal fiber mesh element each engage at least one sidewall of the lower housing unit along with the end cap and the inlet cap such that the distribution element, burner deck, and metal fiber mesh element are secured to the lower housing unit.

An inlet conduit extends into the burner body through the aperture in the inlet cap. With this arrangement, the inlet conduit communicates with the burner body and delivers a gas/air mixture to the burner body in a region located below the distribution element and above the bottom portion of the lower housing unit. In certain embodiments two or more inlet conduits extend into the burner body through two or more apertures in the inlet cap to deliver a gas/air mixture to the burner body.

The burner head (i.e. the combined burner deck and metal fiber mesh layers) has an air permeability greater than 700 liters per hour, more preferably between 1000 and 3500 liters per hour, and even more preferably between 1400 to 2800 liters per hour. The permeability of the burner head is important because if it is less than the minimum, then an excessive amount of nitrogen oxides ($NO_x$) form due to the overly restrictive nature of the air flow during combustion. If the permeability is greater than the maximum, then the risk of a flashback increases significantly. It will be recognized that if the burner deck is so highly permeable as to allow the free flow of gases there through, then the permeability, in that instance, may be defined exclusively by the metal fiber mesh. In one embodiment, the metal fiber mesh element is constructed from a corrosion resistant material such as an iron-chromium-aluminum (FeCrAl) alloy. In one embodiment the metal fiber mesh is a woven sheet of material. In another embodiment the metal fiber mesh is knitted. In yet another embodiment the metal fiber mesh comprises sinterized fibers. Knitted, woven and sinterized metal fiber mesh structures all permit control of permeability of the burner head or metal fiber mesh within the ranges described herein.

The burner deck supports the metal fiber mesh and spaces the metal fiber mesh from the internal distribution element. The burner deck preferably has more permeability than the metal fiber mesh so that it does not further restrict air flow for combustion. In one embodiment the burner deck is constructed from steel. Preferably, the steel construction is corrosion resistant, and may also be magnetic in some embodiments.

In one embodiment, the distribution element has an inverted U-shaped configuration. In this embodiment, the distribution element may include a series round or oval-shaped apertures formed therein. In a more preferred embodiment, the openings are arranged in sets of parallel rows. However, other holes, slots, patterns of distribution (e.g. parallel or random) may be used to form apertures through the distribution element. In other embodiments, the distribution element may be generally rectangular with one end attached to a terminal end of the inlet tube and another end attached to the burner body such that the distribution element is downwardly angled, with the apertures formed as a series of slots. Again, other holes, slots, patterns of distribution (e.g. parallel or random) may be used to form apertures through the distribution element in this embodiment as well. In either embodiment, the apertures may or may not be uniformly spaced or dimensioned, such that the open area density may vary across the surface area of the distribution element.

In one embodiment, the bottom portion of the lower housing unit includes a plurality of ribs to provide added rigidity to the burner body. The added rigidity moves the eigenfrequencies of the system out from the burner operation field, avoiding possible noises. The plurality of ribs may intersect at a central location on the bottom portion and form an X shape on the bottom portion of the lower housing unit. Alternatively, the plurality of ribs may not intersect and instead are arranged in parallel, transverse, diagonal, concentric or other orientation to one another along the bottom portion of the burner body.

In one embodiment, the distribution element, burner deck and metal fiber mesh element engage the sidewalls through crimping or clinching the upper portion of the sidewalls to the layered burner deck and metal fiber mesh. In a preferred embodiment, the distribution element is first positioned relative to the sidewalls of the burner body and then crimped or clinched thereto. The end cap and inlet cap are then positioned at each end of the burner body, perpendicular to the sidewalls and clamped or crimped onto the burner body. In other embodiments the end cap and inlet cap are welded into place. Each of the inlet cap, the end cap and the sidewalls have upwardly extending flanges that are used to secure the burner deck and metal fiber mesh element. Accordingly, in this embodiment, the burner deck and metal fiber mesh element are positioned over the distribution element and clamped or crimped onto the burner body at the sidewalls and also to the inlet cap and the end cap. Alternatively, the distribution element, burner deck and metal fiber mesh element could engage the burner body through spot welding, magnetics or other methods of secure engagement recognized by those of skill in the art.

In an exemplary embodiment, the inlet conduit extends through an aperture in the inlet cap and is secured into position though a series of welds. In a more preferred embodiment, the inlet conduit includes a segment that extends into an interior region of the burner body and has a discharge end that is not angled. According to the illustrated embodiment, the inlet conduit includes a venturi inlet and defines a flow path of an air/gas mixture into an interior region of the burner body. In one embodiment, a mounting plate for a water heater combustion chamber door is positioned on the inlet conduit and then a convergent venturi part is attached to or directly formed with one end of the inlet conduit. The water heater combustion chamber mounting plate is then spot welded into place. The inlet conduit is inserted through an aperture in the inlet cap into the burner body. The internal distribution element has an upper surface that is devoid of overhanging plates, fins, ribs or other outwardly extending features, but includes one or more downwardly extending members that assist in positioning the inlet conduit in the burner body. The inlet conduit is then circumferentially expanded by molding and then spot welded to the inlet cap, securing the inlet conduit to the inlet cap. A portion of the inlet conduit located in the burner body may also be spot welded to the lower surface of the burner body.

According to another aspect of the invention, the burner unit is adapted to function within a gas fired heating apparatus, such as a water heater. In this disclosed embodiment, the heating apparatus includes a combustion chamber and a fluid passage communicating with a combustion chamber through which products of combustion are exhausted. The gas burner constructed in accordance with the invention is located within the combustion chamber. In one embodiment, a generally U-shaped bracket or injector holder receives an injector through an aperture and positions the injector proximate to the venturi inlet of the inlet tube, and preferably co-axial with the inlet tube. The injector releases gas that is mixed with primary air as it enters the venturi inlet for combustion in the burner body.

Additional information and a fuller understanding of the invention can be obtained by reading the accompanying detailed description made in connection with the accompanying drawings.

BEST MODE FOR CARRYING OUT THE INVENTION

Figure 1:
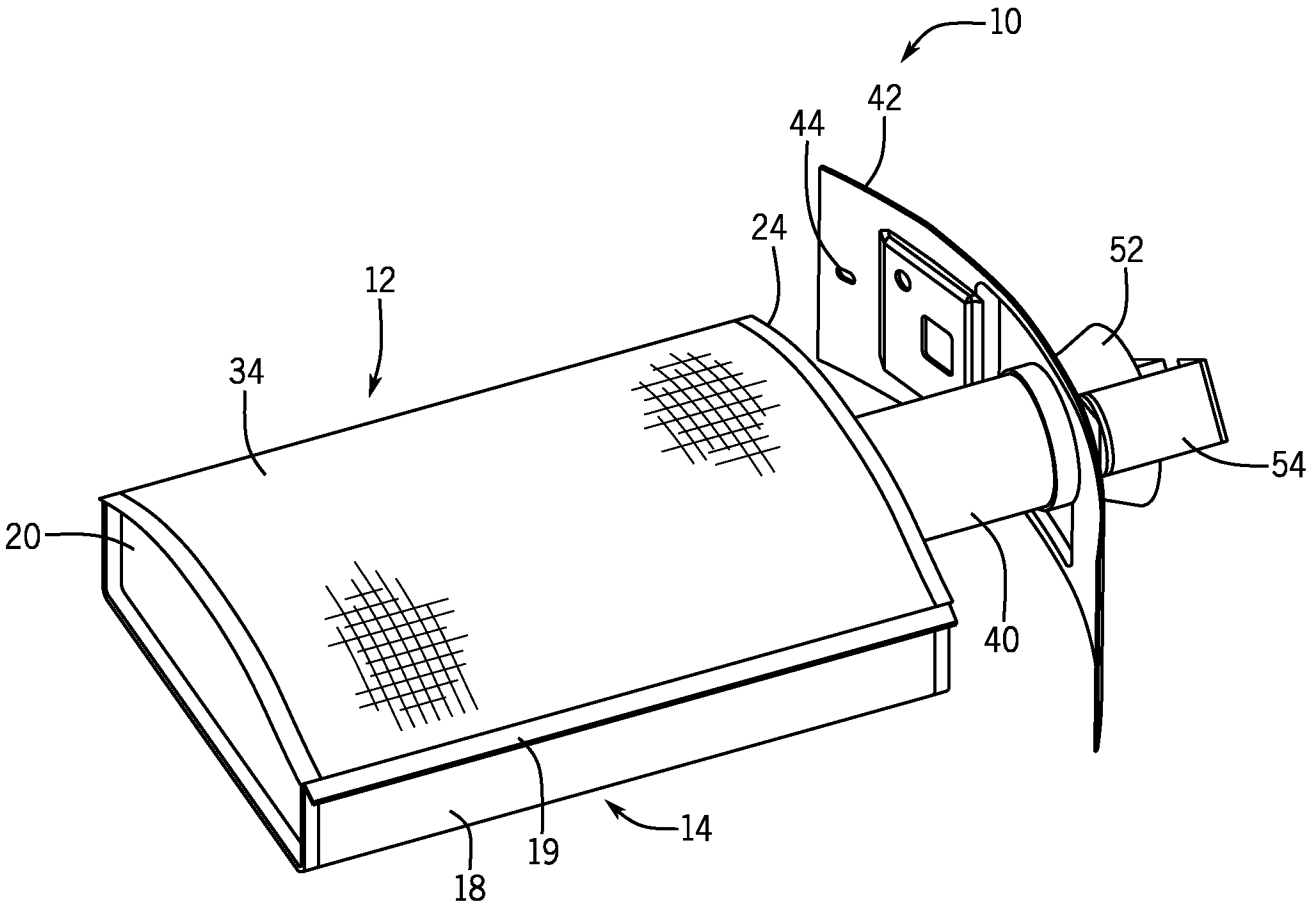
FIG. 1 is a perspective view of a burner unit constructed in accordance with a preferred embodiment of the invention.
Figure 5:
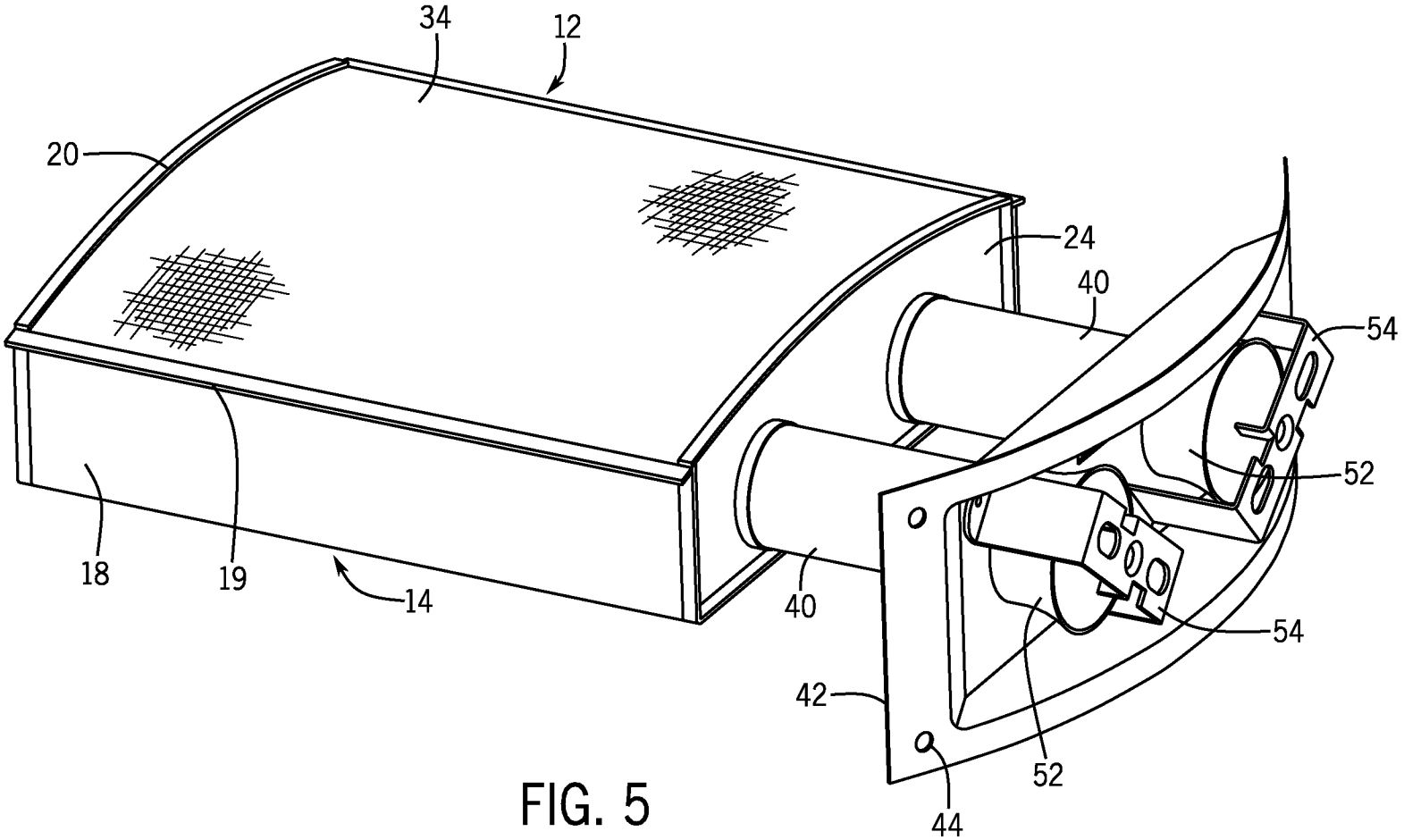
FIG. 5 is a perspective view a burner unit constructed in accordance with a preferred embodiment of the invention where two conduits are utilized.

FIGS. 1 and 5 illustrate a burner unit 10 constructed in accordance with preferred embodiments of the invention. The disclosed burner unit 10 is configured to operate at high efficiency and produce low emissions relative to more conventional burners. The burner unit 10 associates with means of providing combustible gas to the burner (not shown), such as gas manifolds with gas orifices as is well known in the art. The discharged gas entrains and mixes with air as the gas enters the burner unit 10. The entrained air is generally termed primary air. In the exemplary figures, the burner unit 10 is shown in a water heating application. It should be noted that a water heater is but one example of the type of gas appliance with which the disclosed burner can be used. The invention itself is not limited to water heating applications. The burner may be used in many other types of gas fired appliances such as room heaters, boilers cooking appliances and ovens.

Figure 2:
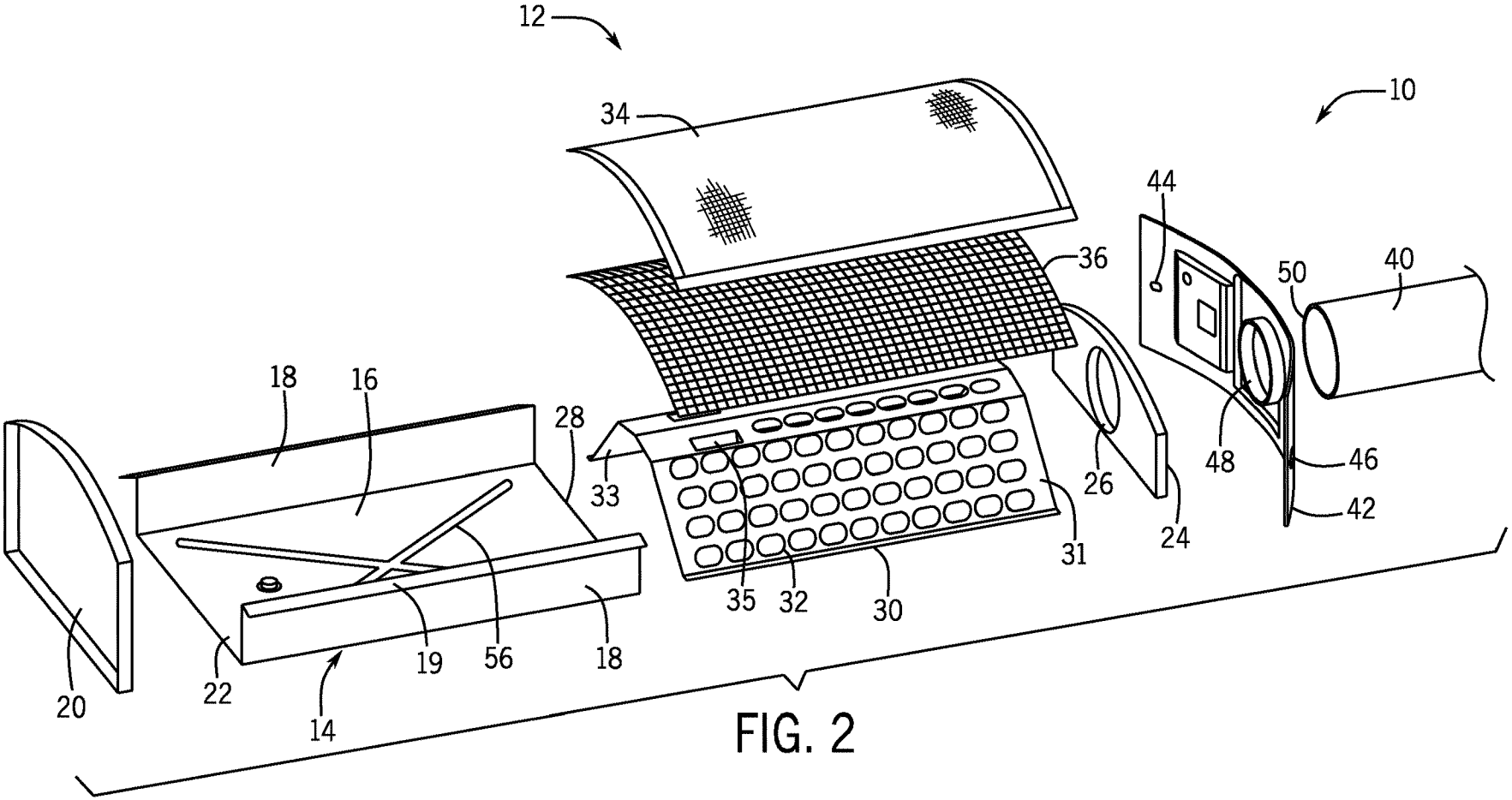
FIG. 2 is an exploded view of a burner unit constructed in accordance with a preferred embodiment of the invention.
Figure 6:
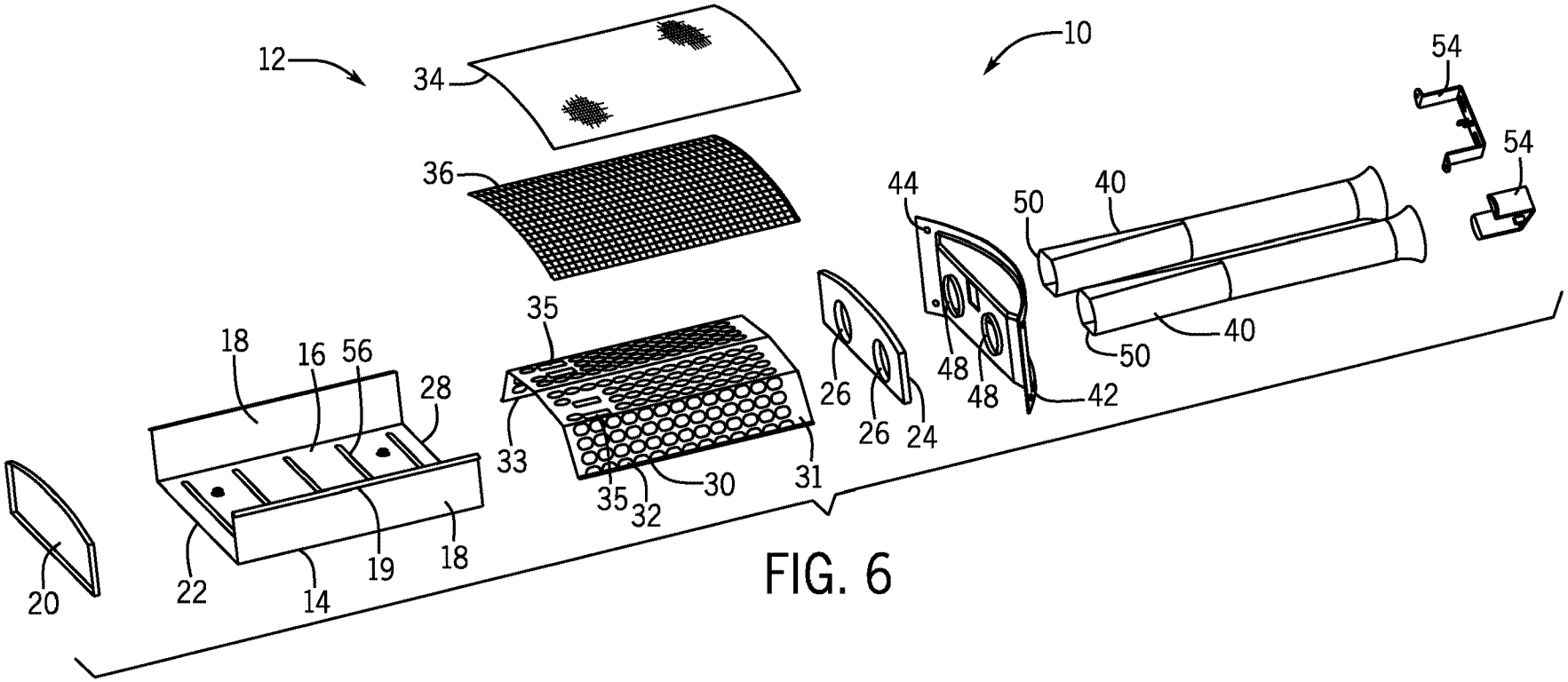
FIG. 6 is an exploded view of a burner unit constructed in accordance with a preferred embodiment of the invention where two conduits are utilized.

The burner unit 10 includes a burner body 12. The burner body 12 includes a lower housing unit 14. As shown in FIGS. 1, 2, 5 and 6, the lower housing unit 14 includes a bottom portion 16 and a pair of upwardly extending sidewalls 18. The lower housing unit 14 engages with an end cap 20 that attached to a first, terminal end 22 of the lower housing unit 14. An inlet cap 24 having at least one inlet aperture 26 is attached to a second inlet end 28 of the lower housing unit 14. The bottom portion 16 of the lower housing unit may include a plurality of ribs 56 to provide added rigidity to the burner body 12. The added rigidity aids in eliminating combustion noise. As shown in FIG. 2, the plurality of ribs 56 may intersect at a central location on the bottom portion 16 and form an X shape on the bottom portion 16 of the lower housing unit 14. Alternatively, as shown in FIG. 6, the plurality of ribs 56 may not intersect and instead are arranged in parallel fashion along the bottom portion of the burner body 12. Alternatively, other arrangements of the ribs 56 may be used, including but not limited to transverse, diagonal, concentric or other orientations relative to one another along the bottom portion of the burner body 12.

Referring now to FIGS. 2 and 6, a distribution element 30 is located above the bottom portion 16 of the lower housing unit 14. In the embodiment shown in FIG. 2, the distribution element 30 has an inverted U-shaped configuration. The distribution element 30 may constructed any heat resistant metal and is preferably constructed of a sheet metal such as stainless steel, and may be constructed of aluminized steel or galvanized steel. The distribution element 30 includes a series of openings or apertures 32 formed therein through which the gas mixture travels on its way to a combustion surface defined by a metal fiber mesh element 34. In the demonstrated embodiments, the apertures 32 are round or oval-shaped and arranged in sets of parallel rows, but such shape and arrangement is not necessary. The internal distribution element 30 has an upper surface 31 that is devoid of overhanging plates, fins, ribs or other outwardly extending features. The lower surface 33 of the distribution element 30 includes one or more pair of downwardly extending members 35 that assist in positioning one or more inlet conduits 40 in the burner body 14.

The distribution element 30 is designed to enhance the mixing of gas and air and more uniformly distribute the gas/air mixture to the metal fiber mesh element 34 for combustion, while also helping to secure each inlet conduit 40 into proper position. The distribution element 30 also aids in reflecting radiant energy away from the interior of the burner, aiding in efficiency. The distribution element 30 may be constructed from a sheet metal stamping wherein the apertures 32 are formed by stamping through the material. Alternatively, the apertures 32 may comprise other shaped holes, slots, or openings, along with alternative patterns of distribution (e.g. parallel or random). Moreover, the apertures may or may not be uniformly spaced or dimensioned, such that the open area density may vary across the surface area of the distribution element. In one alternative embodiment, the distribution element 30 may be of generally rectangular construction with one end attached to a terminal end of the inlet tube and another end attached to the burner body such that the distribution element is downwardly angled, with the apertures 32 formed as a series of slots through the distribution element 30.

Figure 4:
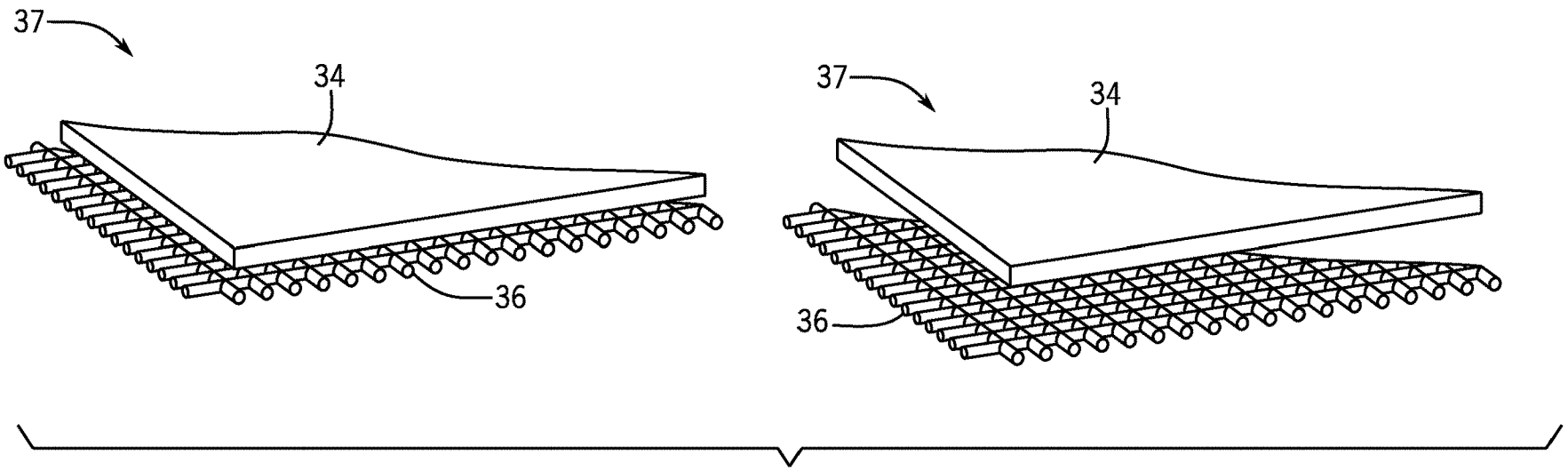
FIG. 4 is a diagram with perspective views showing construction of the burner head of the present application.

As shown in FIGS. 2 and 6, the fiber mesh element 34 that defines the combustion surface is located above the distribution element 30. Located above the distribution element 30, but below the fiber mesh element 34 is a burner deck 36. Both the fiber mesh element 34 and the burner deck 36 may be radiused. As shown in FIG. 4, the combination of the fiber mesh element 34 and the burner deck 36 defines a burner head 37. By locating the burner head 37 above the distribution element 30, the upper combustion surface defined by the fiber mesh element 34 of the burner is spaced from distribution element 30, permitting enhanced distribution of the air/gas mixture along the fiber mesh element 34 while also providing added rigidity to the fiber mesh element 34. This added rigidity operates to inhibit vibration in the fiber mesh element 34 which may occur during operation of the burner unit, for example during the initial start up of the burner unit.

The metal fiber mesh element 34 may be constructed from several materials such as a high temperature steel alloy wire cloth or from material sold under the trade name/trademarks INCONEL and NICROFER. In the demonstrated embodiment, however, the metal fiber mesh element 34 is constructed from an iron-chromium-aluminum alloy (FeCrAl). In one embodiment, the composition of the fiber comprises 18-24% by weight Cr, 4-8% by weight Al, and the balance Fe. In other embodiments, the fiber comprises 18-24% by weight Cr, 4-8% by weight Al 0.40% by weight maximum C, 0.07% by weight maximum Ti, 0.40% by weight maximum Mn, 0.045% by weight maximum S, 0.045% by weight maximum P, 0.60% by weight maximum Si, and the balance Fe. In still another embodiment, the composition of the fiber comprises the fiber comprises 18-24% by weight Cr, 4-8% by weight Al, 0.40% by weight maximum C, 0.07% by weight maximum Ti, 0.40% by weight maximum Mn, 0.045% by weight maximum S, 0.045% by weight maximum P, 0.60% by weight maximum Si, 0.001 to 0.10% by weight rare earth metal, and the balance Fe. In one exemplary embedment, the rare earth metal is Yttrium or Hafnium.

By using one of the preferred alloys, the burner head 37 is able to achieve an air permeability greater than 700 liters per hour (L/hr), more preferably at 1000 to 3500 liters per hour, even more preferably at 1400 to 2800 liters per hour. In some instances it may be preferred to select a permeability range of the burnet head 37 to be between 1600 to 2300 liters per hour, while in other instances the range may be 1400 to 2000 L/hr, 1500 to 2100 L/hr, 1600 to 2200 L/hr, 1700 to 2300 L/hr, 1800 to 2400 L/hr 1900 to 2500 L/hr, 2000 to 2600 L/hr, 2100 to 2700 L/hr or 2200 to 2800 L/hr. The permeability of the burner head 37 and the metal fiber mesh element 34 is important because if it is less than the minimum, then an excessive amount of nitrogen oxides ($NO_x$) form due to the overly restrictive nature of the air flow during combustion. If the permeability is greater than the maximum, then the risk of a flashback increases significantly.

All permeability values noted herein were determined by internal testing at room temperature as follows. The metal fiber mesh element 34, in its different constructions noted herein, were cut into a sample of circular shape with a diameter of 60 mm and welded on a circular frame made of a metal sheet having an outer diameter of 60 mm and a concentric hole with a diameter of 40 mm. Each sample of the metal fiber mesh element 34 was then secured in an air-tight sample holder connected on both sides with two tubes with an inner diameter of 40 mm to create a duct with a constant 40 mm diameter, with the sample of the metal fiber mesh element 34 to be analyzed located at a central point of the duct. Accordingly, the air flow passing through the sample flows through a circular probed area of 40 mm diameter, having an area of 1,256.6 $mm^2$. Pressure measurements were made in the 40 mm diameter tubes at about 4 cm in front of and beyond the location of the metal fiber mesh element 34 sample. When air flow passed through the system the air flow was measured and regulated. The air flow was set when a pressure drop of 5 Pa+/−0.1 Pa was reached. The pressure drop was measured as the difference between the pressure at the point before the sample holder and the one after it, with reference to the direction of the air flow. When the target pressure drop was reached, the value of air flow measured by a standard air flow meter was recorded and converted to in Liters/hours. This value is recorded internally as the air permeability, and those values are set forth herein.

The metal fiber mesh element 34 may be constructed from monofilament fibers, bundled fibers or other arrangements. In one embodiment, the metal fiber mesh element 34 is a knitted mesh having a fiber cross sectional dimension between 5 and 60 μm, and preferably between 25 and 45 μm. The knitted mesh may have weight per square meter ($kg/m^2$) between 1.10 $kg/m^2$ and 2.60 $kg/m^2$ and alternatively between 1.50 $kg/m^2$ and 2.20 $kg/m^2$, 1.10 $kg/m^2$ and 1.90 $kg/m^2$ or 1.80 $kg/m^2$ and 2.60 $kg/m^2$; a thickness (mm) between 1.20 mm and 2.80 mm and alternatively between 1.60 mm and 2.40 mm, 1.2 mm and 2.2 mm, or 2.00 mm and 2.8 mm; and an air permeability greater than 700 L/hr, and alternatively between 1400 and 2800 L/hr. In another embodiment, the metal fiber mesh element 34 is a woven fiber element having a fiber cross sectional dimension between 5 and 60 μm, and preferably between 25 and 45 μm. The woven fiber mesh may have weight per square meter between 0.60 $kg/m^2$ and 1.5 $kg/m^2$ and alternatively between 0.80 $kg/m^2$ and 1.2 $kg/m^2$, 0.60 and 1.1 $kg/m^2$ or 0.9 and 1.5 $kg/m^2$; a thickness (mm) between 0.50 mm and 2.00 mm and alternatively between 0.75 mm and 1.75 mm, 0.50 mm to 1.50 mm, or 1.00 to 2.00 mm; and an air permeability greater than 700 L/hr, more preferably at 1000 to 3500 liters per hour, even more preferably at 1400 to 2800 liters per hour. By managing the weft and warp of the metal fiber mesh element 34, the permeability ranges described herein may be achieved.

Further, by using the preferred FeCrAl alloy, the metal fiber mesh element 34 provides a beneficial oxidation behavior creating a protective layer that protects against the diffusion of oxygen. During the first 100 hours of use as a combustion surface, a FeCrAl metal fiber mesh will generate an aluminum oxide scale from the aluminum component in the metal fiber mesh fibers. The aluminum oxide scale grows until all of the aluminum in the fibers is depleted. After the aluminum is depleted, chromium oxides from the chromium constituency in the fibers; however the chromium oxides are found to be less protective than the aluminum oxides. The adhesion of the aluminum oxide scales to the metal fiber mesh element 34 depends on the compositional parameters of the mesh fibers. Particularly, the presence of rare earth elements in the alloy was found to provide better aluminum oxide scale adherence. As noted, the presence of the aluminum oxide later enhances the durability of the metal fiber mesh element 34 and is influenced by the kinetic of aluminum oxide scale growth and initial aluminum content of the alloy, specific surface exposed to the atmosphere (which depends, in part, on fiber cross sectional dimension), and the tendency of aluminum oxide spalling.

The burner deck 36 also may be constructed from several materials such as a high temperature steel alloy wire cloth that may be knitted or woven. Alternatively, the burner deck 36 may be constructed from a stamped or punched metal sheet. Preferably, the burner deck 36 is constructed from a non-corrosive alloy such as steel, preferably stainless steel or aluminized steel so as to provide the desired rigidity to support the metal fiber mesh element 34 and enhance diffusion of the air/gas mixture. The burner deck 36 may also be magnetic in some embodiments. The burner deck 36 preferably has more permeability than the metal fiber mesh element 34 so that it does not further restrict air flow for combustion.

Figure 7:
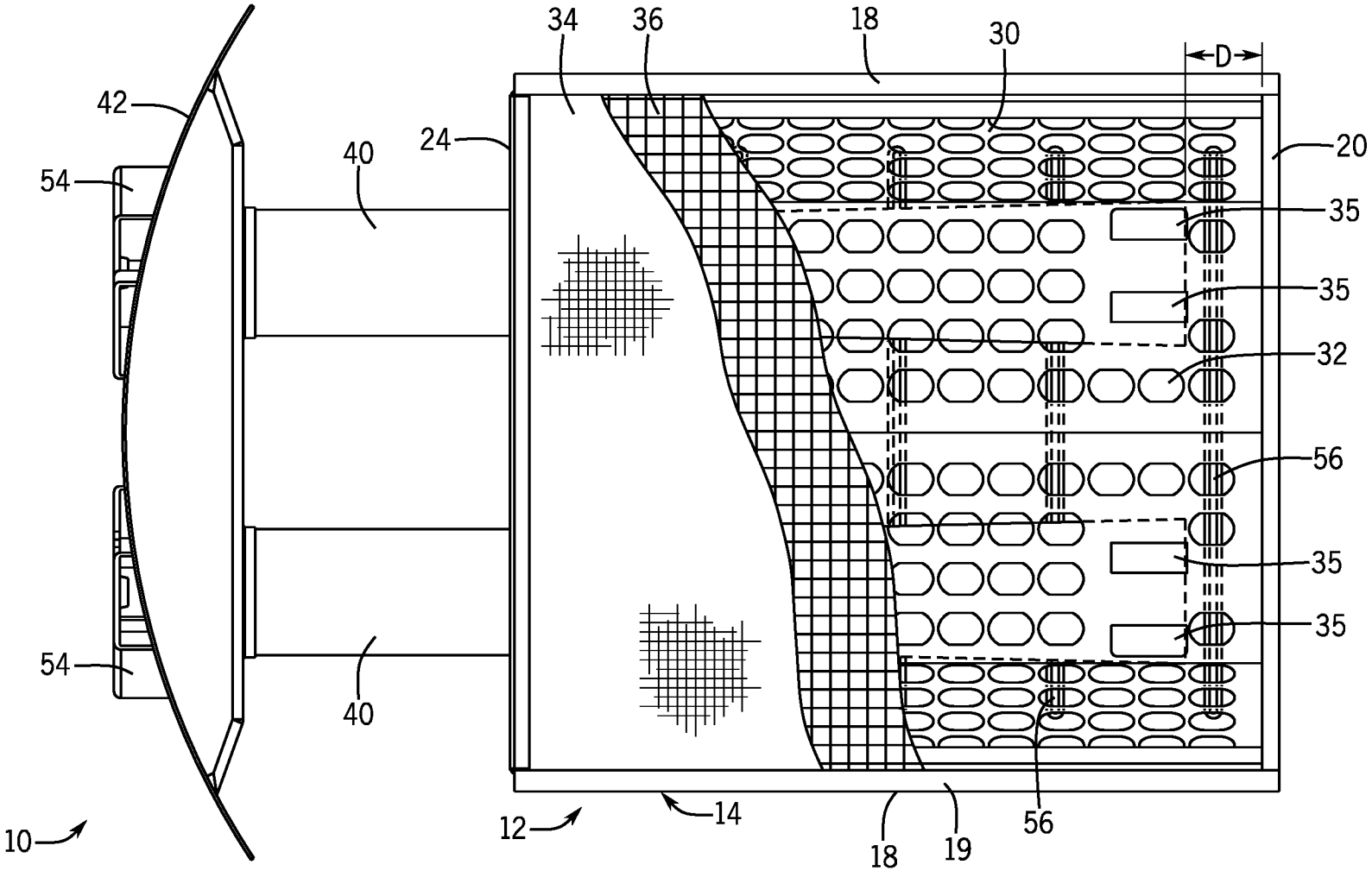
FIG. 7 is a top view of a burner unit constructed in accordance with a preferred embodiment of the invention where two conduits are utilized.

The combined structure of the distribution element 30, the burner deck 36, and the fiber mesh element 34 relative to the lower unit 14 operates to dissipate radiant energy generated at the combustion surface away from the lower housing unit 14 and inlet conduit(s) 40. This permits the lower housing unit 14 to operate at a lower temperature, reducing undesirable radiant energy paths. It should be noted that the thermal output capability of a burner may be varied by changing the size of the distribution element 30, the burner deck 36, and the fiber mesh element 34. One way of increasing the size of these elements is to increase their longitudinal dimension, and hence the longitudinal dimension of the burner unit 10. Another method is to increase the lateral dimension, effectively increasing the widths of the bottom surface 16, of the inlet cap 24, of the end cap 20, of the distribution element 30, of the burner deck 36 and of the fiber mesh 34. In the case of the distribution element 30, one method for increasing its dimension is by adding additional rows of apertures. Accordingly, a burner unit having increased dimensions will have a larger thermal output capability. Additionally, two or more inlet conduits 40 may be incorporated as shown in FIGS. 5-7 to increase the thermal capacity.

The distribution element 30, burner deck 36, and metal fiber mesh element 34 may each engage at least one sidewall 18 of the lower housing unit 14 along with the end cap 20 and the inlet cap 24 such that the distribution element 30, burner deck 36, and metal fiber mesh element 34 are secured to the lower housing unit 14 and spaced upwardly and away from the bottom portion 16 of the lower housing unit 14. The burner deck 36, and metal fiber mesh element 34 may engage the lower housing unit 14 though crimping or clinching an upper portion 19 of the sidewalls 18 to the layered burner deck 36 and metal fiber mesh 34. In one embodiment, the distribution element 30 is first positioned relative to the bottom 16 and the sidewalls 18 of the burner body 14. The distribution element 30 may be fastened to the bottom 16 by spot welding, stamping, clinching, bolting or securing though other means of attachment. Alternatively, distribution element 30 may be fastened to respective sidewalls 18 by spot welding, stamping, clinching, bolting or securing though other means of attachment or by crimping or clinching with the upper portions 19 of the sidewalls 18. The end cap 20 and the inlet cap 24 may then be positioned at each end 22, 28 of the burner body 14, perpendicular to the sidewalls 18. The end cap 20 and the inlet cap 24 are secured onto the burner body 14 by crimping or clinching. In other embodiments, the end cap 20 and inlet cap 24 are secured to the burner body 14 by welding, stamping, bolting or securing through other means known in the art. In one embodiment, each of the inlet cap 24, the end cap 20 and the sidewalls 18 have upwardly extending flanges 19 that are used to secure the burner deck 36 and metal fiber mesh element 34 to the burner body 14. Accordingly, in this embodiment, the burner deck 36 and metal fiber mesh element 34 are positioned over the distribution element 30 and clamped or crimped onto the burner body 14 at the sidewalls 18 and also to the inlet cap 24 and the end cap 20 by clamping or crimping the flanges 19 of the sidewalls 18, the inlet cap 24 and the end cap 20 to secure the edges of the burner deck 36 and metal fiber mesh element 34. Alternatively, the distribution element 30, burner deck 36 and metal fiber mesh element 34 may engage the burner body 14 through spot welding, magnetics or other methods of secure engagement recognized by those of skill in the art.

Alternatively, the lower housing unit 14 may be formed with an integral end cap 20 and inlet cap 24 generated from a unitary, stamped housing. In this alternate embodiment, separate flange elements 19 are used to clamp or crimp corresponding side edges of the burner deck 36 and metal fiber mesh element 34 to the sidewalls 18, the inlet cap 24 and the end cap 20 to secure the edges of the burner deck 36 and metal fiber mesh element 34.

Figure 3:
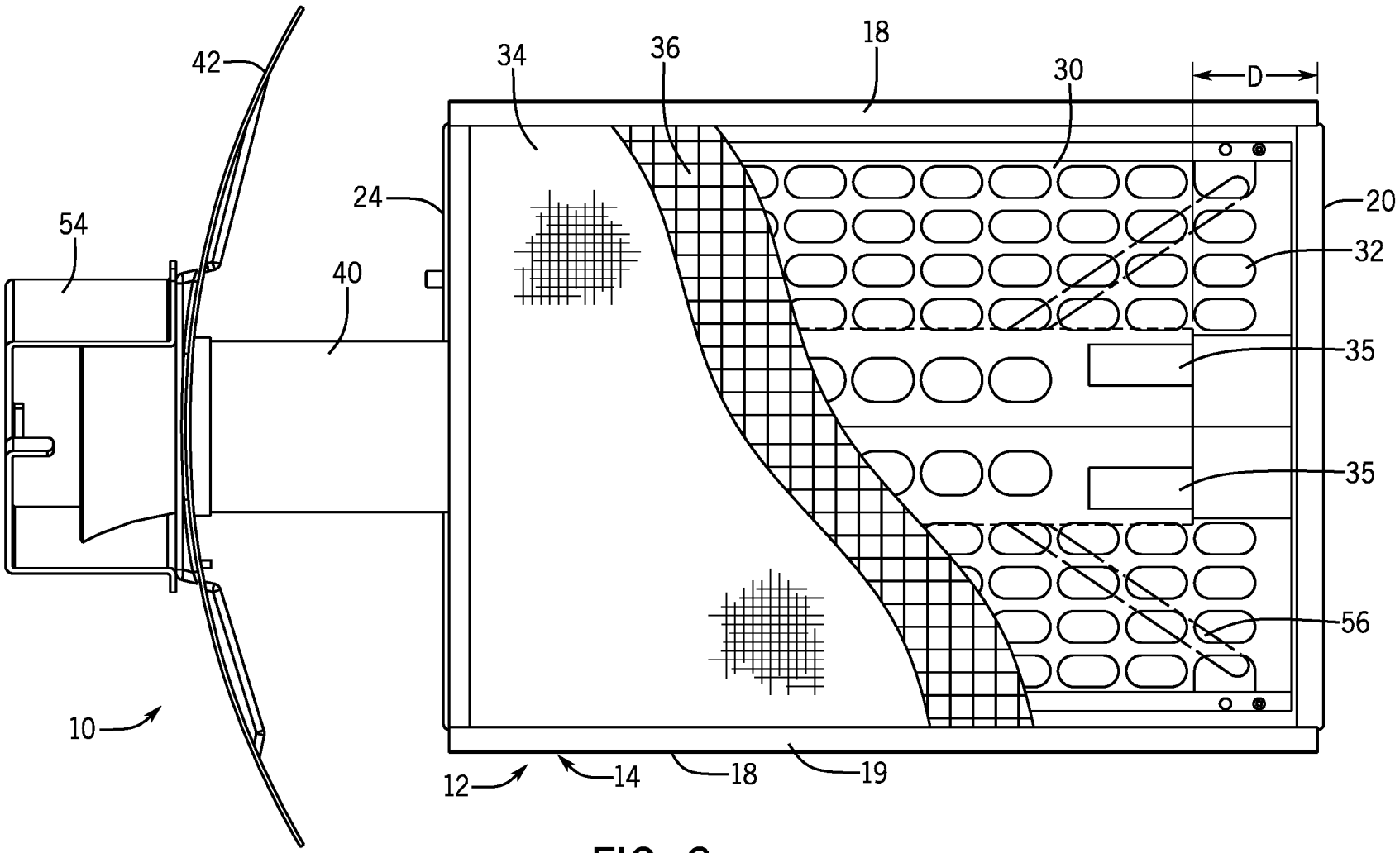
FIG. 3 is a top view of a burner unit constructed in accordance with a preferred embodiment of the invention and demonstrating in section layers below the combustion surface.

Each inlet conduit 40 is preferably a venturi inlet conduit that delivers a mixture of gas and primary air into the lower housing unit 14 at or near the lower surface 16. As previously noted, the inlet cap 24 includes at least one aperture 26. Each aperture 26 of the inlet cap 24 receives an inlet conduit 40 such that a terminal end 50 of the inlet conduit 40 may be located in the burner body 12 adjacent the lower surface 16 of the lower housing unit 14. Each inlet conduit 40 is sealingly engaged with the inlet cap 24 by first inserting the conduit 40 through the aperture 26 to a predetermined depth, then by mechanically circumferentially enlarging the inlet conduit 40 after locating the inlet conduit 40 at the desired position in the inlet cap 24, and subsequently by spot welding the inlet cap 24 to the inlet conduit 40 to fix the conduit 40 in place and to seal the conduit such that the air/gas mixture flows exclusively into the interior of the burner body 12. As shown in FIGS. 3 and 7, the predetermined depth is defined as distance D, and the internal distribution element 30 may include a pair or pairs of downwardly extending members 35 that assist in centrally positioning each inlet conduit 40 in the burner body 14. Distance D may be between 15 to 50 mm, and in a more preferred embodiment is between 20 to 40 mm. Distance D is important because it is a functional dimension that optimizes the draft of primary air into the burner body 10 for combustion. By establishing distance D in the ranges identified above, the quantity of primary air is optimized for lowering the $NO_x$ emissions.

As mentioned, the depicted embodiment demonstrates the burner unit 10 in a water heater application. These aspects are conventional and do not form part of the invention and is not shown in any of the drawings. The water heater itself may be of conventional design with a cylindrical shell or housing that encloses or defines a chamber for holding water to be heated and a combustion chamber. Such a conventional heater also includes a flue passage extending through the center of the housing and connected to a flue passage, chimney or other conduit for discharging the byproducts of combustion generally outside a structure where the water heater is located. A dome or cap structure or separating wall may define the flue passage and may also define the bottom of the water chamber and the top of the combustion chamber. As is well known in the art, the burner unit 10 is suspended within the combustion chamber and located below the flue passage, typically on a base plate attached to the interior bottom of the combustion chamber. An annular ring having apertures extending downwardly from the base plate serves as a base for the water heater, spacing it from the ground. Secondary air that is necessary for the proper operation of the burner unit 10, is admitted into the combustion chamber through a plurality of apertures formed in the base plate. The conventional water heaters also typically include an ignition device, such as a pilot for igniting the burner.

Referring to FIGS. 1-3, and 5-7 certain components that are used when the burner 10 is mounted within a water heater are illustrated. As is conventional, a water heater shell typically defines a somewhat rectangular opening through which the burner unit 10 is inserted or accessed. To accommodate conventional water heater constructions, the burner unit 10 of the present invention includes a mounting plate 42 that supports the inlet conduit 40. Mounting plate 42 may also be referred to as a door or bulkhead fitting. During installation, the mounting plate 42 is secured to and overlies the rectangular opening in the water heater shell. In the illustrated embodiments, the mounting plate 42 includes apertures 44, 46 through which fasteners (not shown) extend to engage the water heater shell. A suitable gasket or gasket material is typically used to seal the mounting plate 42 to the water heater shell.

In an exemplary embodiment, each inlet conduit 40 extends through an aperture 26 in the inlet cap 24 to a predetermined length and is located into position though a series of welds. In a more another exemplary embodiment, each inlet conduit 40 includes a segment that extends into an interior region of the burner body 14 and has a discharge end 50 that is not angled. According to the illustrated embodiment of FIGS. 1-3 and 5-7, the inlet conduit 40 includes a venturi inlet 52 and defines a flow path of an air/gas mixture into an interior region of the burner body 14. In one exemplary embodiment shown in FIGS. 1-3, a mounting plate 42 for a water heater combustion chamber door is positioned on the inlet conduit 40 by inserting the inlet conduit 40 through an aperture 48 in the mounting plate 42. The inlet end 50 of the inlet conduit 40 is inserted through the opening 48 in the mounting plate 42, then a convergent venturi part 52 is attached to one end of the inlet conduit 40. Alternatively, the convergent venturi part 52 is formed directly with the inlet conduit 40. The inlet conduit 40 abuts the mounting plate 42 and is held in predetermined alignment while a suitable tool is used to mechanically expand the inlet end of the inlet conduit outwardly such that the outer surface of the inlet conduit 40 engages the inner surface of the opening 48. The inlet conduit 40 may then be welded into a fixed position relative to the mounting plate 42. The inlet conduit 40 is then inserted through an aperture 26 in the inlet cap and into the burner body 14. As noted, the internal distribution element 30 has a pair of downwardly extending members 35 that assist in centrally positioning the inlet conduit 40 in the burner body 14. The inlet conduit 40 may then be further mechanically circumferentially expanded and then spot welded to the inlet cap 24, securing the inlet conduit 40 to the inlet cap 24 and positioning the inlet conduit 40 within the burner body 14 for use. A portion of the inlet conduit 40 located in the burner body may also be spot welded to the lower surface 16 of the burner body 14. The resulting connection is both rigid and gas-tight. As shown in the embodiment of FIGS. 5-7, one or more inlet conduits 40 may be used in accordance with the present invention. In this instance, the process described above is followed, but the respective inlet conduits 40 will be laterally spaced from one another, the mounting plate 42 will include two or more apertures 48, and two or more apertures 26 will be formed in the inlet cap 26 to accommodate the two or more inlet tubes 40. Additional downwardly extending members 35 to assist in centrally positioning the inlet conduits 40 in the burner body 14 may also be incorporated in to the internal distribution element 30. In instances with one or more inlet tubes 40, the burner unit 10 with the mounting plate 42 attached is inserted through into a water heater tank until the mounting plate 42 abuts the water heater shell. Fasteners or other means are then used to secure the mounting plate 42 to the shell thus suspending the burner unit 10 within the combustion chamber.

The inlet end 52 of each inlet conduit 40 is of conical shape and is located outside the mounting plate 42, and therefore would be located outside of the tank shell when connected to a water heater. In an alternative embodiment, the inlet end 52 of an inlet conduit 40 may be located inside of the combustion chamber. A source of combustible gas in the form of a gas nozzle is then typically positioned adjacent the inlet end 52 of each inlet conduit 40. When mounted in position, the gas nozzle is aligned generally with the axis of the inlet conduit 40 and is spaced a predetermined distance from the inlet end 52. As is conventional, gas emitted by the gas nozzle enters the inlet 52 of the inlet conduit 40 along with primary air and is mixed using the venturi effect created by the conical shape of the inlet end 52. As the gas and entrained primary air travel through the inlet conduit 40 and through the distribution element 30, additional mixing occurs so that a substantially homogenous gas mixture is formed. Again, when more than one inlet conduit is incorporated into the design, corresponding gas nozzles will be incorporated.

Referring to FIGS. 1 and 5, the burner unit 10 may include one or more bracket or nozzle holder 54 to hold the gas nozzle in a predetermined position with respect to an inlet opening 52 of an inlet conduit 40. The bracket or nozzle holder 54, in the illustrated embodiments, is a sheet metal structure and is generally U-shaped to receive a gas nozzle. The bracket or nozzle holder 54 may include a plurality of attaching elements to secure the bracket or nozzle holder 54 to the mounting plate 42. The bracket or nozzle holder 54 may be attached to the mounting plate 42 prior to insertion of the burner unit 10 into a combustion chamber. Alternately, the bracket or nozzle holder 54 can be attached to the mounting plate 42 after the burner body 12 is located in the combustion chamber and the mounting plate 42 is secured. A conventional cover including a locking lug may then be installed over the bracket or nozzle holder 54.

It should be noted that the assembly steps described above can be varied substantially depending on the actual design and the methods normally used by the manufacture of the appliance in which the burner is used. The invention should, therefore, not be limited to the order of the steps as discussed above or the steps themselves.

The present invention thus provides a burner unit that is adaptable to existing water heater constructions as well as other gas appliances. The burner is intended to be located within a non sealed combustion chamber of a water heater and in fact relies on secondary air admitted into the combustion chamber to enhance burner operation. In water heater applications, the burner of the present invention can be configured to receive primary air from a region immediately outside the water heater housing or, alternately, to receive its primary air through the water heater base plate.

Although the invention has been described with a certain degree of particularity, it should be noted that those skilled in the art can make various changes to it without departing from the spirit or scope of the invention as hereinafter claimed.

What is claimed is:

1. A gas burner unit comprising:

a burner body, the burner body having a lower housing unit with a bottom portion and at least one upwardly extending sidewall; an end cap; an inlet cap having an inlet aperture; a distribution element located above the bottom portion; a burner deck located above the distribution element; and a metal fiber mesh element located above the burner deck; the burner deck supporting the metal fiber mesh and spacing the metal fiber mesh from the distribution element to define a burner head; the burner deck and metal fiber mesh element each engaging at least one sidewall of the lower housing unit, the end cap and the inlet cap; and an inlet conduit communicating with the burner body and extending into the burner body through the inlet aperture in the inlet cap and delivering a gas/air mixture to the burner body in a region located below the distribution element and above the bottom portion of the lower housing unit;

wherein the bottom portion of the lower housing unit includes a plurality of ribs that extend along a surface of the bottom portion and beneath the distribution element and that are configured to enhance rigidity of the burner body.

2. The gas burner unit of claim 1, wherein the plurality of ribs intersect at a central location on the bottom portion.

3. The gas burner unit of claim 1, wherein the plurality of ribs do not intersect.

4. The gas burner unit of claim 1, wherein the metal fiber mesh element is constructed from an iron-chromium-aluminum alloy.

5. The gas burner unit of claim 1, wherein the metal fiber mesh element is a knitted metal fiber mesh.

6. The gas burner unit of claim 1, wherein the metal fiber mesh element is a woven metal fiber mesh.

7. The gas burner unit of claim 5, wherein the metal fiber mesh element is constructed from iron-chromium-aluminum alloy fibers having a cross sectional dimension between 5 and 60 μm, and wherein the metal fiber mesh has a thickness between 1.20 mm and 2.80 mm and a weight per square meter between 1.10 kg/m$^2$ and 2.6 kg/m$^2$.

8. The gas burner unit of claim 5, wherein the metal fiber mesh element is constructed from iron-chromium-aluminum alloy fibers having a cross sectional dimension between 25 and 45 μm, and wherein the metal fiber mesh has a thickness between 1.60 mm and 2.40 mm and a weight per square meter between 1.50 kg/m2 and 2.2 kg/m$^2$.

9. The gas burner unit of claim 6, wherein the metal fiber mesh element is constructed from iron-chromium-aluminum alloy fibers having a cross sectional dimension between 5 and 60 μm, and the metal fiber mesh has a thickness between 0.50 mm and 2.00 mm and a weight per square meter between 0.60 kg/m2 and 1.5 kg/m$^2$.

10. The gas burner unit of claim 6, wherein the metal fiber mesh element is constructed from iron-chromium-aluminum alloy fibers having a cross sectional dimension between 25 and 45 μm, and the metal fiber mesh has a thickness between 0.75 mm and 1.75 mm and a weight per square meter between 0.80 kg/m2 and 1.2 kg/m$^2$.

11. The gas burner unit of claim 4, wherein the alloy comprises 18-24% by weight Cr, 4-8% by weight Al, and 68-78% by weight Fe.

12. The gas burner unit of claim 4, wherein the alloy comprises 18-24% by weight Cr, 4-8% by weight Al, 0.40% by weight maximum C, 0.07% by weight maximum Ti, 0.40% by weight maximum Mn, 0.045% by weight maximum S, 0.045% by weight maximum P, 0.60% by weight maximum Si, and 66.44-78% by weight Fe.

13. The gas burner unit of claim 4, wherein the alloy comprises 18-24% by weight Cr, 4-8% by weight Al, 0.40% by weight maximum C, 0.07% by weight maximum Ti, 0.40% by weight maximum Mn, 0.045% by weight maximum S, 0.045% by weight maximum P, 0.60% by weight maximum Si, 0.001 to 0.10% by weight rare earth metal or Hafnium, and 66.34-77.999% by weight Fe.

14. The gas burner unit of claim 13, wherein the rare earth metal is Yttrium.

15. The gas burner unit of claim 1, wherein the metal fiber mesh element comprises sinterized fibers.

16. The gas burner unit of claim 1, wherein the at least one inlet conduit communicating with the burner body and extending into the burner body extends into the burner body such that a terminal end of the inlet conduit is located at a distance between 15 to 50 mm from the end cap.

17. The gas burner unit of claim 16, wherein the terminal end of the at least one inlet conduit is located at a distance between 20 to 40 mm from the end cap.

18. The gas burner unit of claim 1, wherein a permeability of the burner deck is greater than a permeability of the metal fiber mesh.

19. The gas burner unit of claim 1, wherein the plurality of ribs are formed in the bottom portion of the lower housing unit.

20. The gas burner unit of claim 1, wherein the metal fiber mesh is in contact with the burner deck.

21. The gas burner unit of claim 1, wherein the inlet cap includes a second inlet aperture, and a second inlet conduit communicates with the burner body and extends into the burner body through the second inlet aperture in the inlet cap.

22. The gas burner unit of claim 1, wherein the distribution element includes at least one downwardly extending member configured to centrally position the inlet conduit in the burner body.

* * * * *